United States Patent [19]

Cassidy

[11] 4,073,553

[45] Feb. 14, 1978

[54] MAG CARD STORAGE DEVICE

[75] Inventor: Raymond T. Cassidy, Ashfield, Mass.

[73] Assignee: National Blank Book Company, Inc., Holyoke, Mass.

[21] Appl. No.: 687,181

[22] Filed: May 17, 1976

[51] Int. Cl.[2] ..... A47B 63/00; G09F 11/06

[52] U.S. Cl. ..... 312/184; 312/183; 211/50; 40/67

[58] Field of Search ..... 312/184, 183, 189; 402/4, 38; 40/67, 140.18; 211/50

[56] References Cited

U.S. PATENT DOCUMENTS

| | | | |
|---|---|---|---|
| 382,065 | 5/1888 | Watson | 40/67 |
| 622,940 | 4/1899 | Brydges | 312/183 |
| 1,076,083 | 10/1913 | Vance | 40/67 |
| 1,990,019 | 2/1935 | Blackwood | 40/67 |
| 2,021,083 | 11/1935 | Novak | 40/67 |
| 2,404,205 | 7/1946 | Ammon | 211/50 |
| 2,612,168 | 9/1952 | Stark | 40/67 |
| 3,253,871 | 5/1966 | Karper | 312/184 |
| 3,489,475 | 1/1970 | Boyce et al. | 312/183 |
| 3,503,496 | 3/1970 | Kovarik et al. | 40/67 |
| 3,779,152 | 12/1973 | Smith | 211/50 |

*Primary Examiner*—Paul R. Gilliam
*Assistant Examiner*—Victor N. Sakran
*Attorney, Agent, or Firm*—Chapin, Neal and Dempsey

[57] ABSTRACT

A card filing device for storing and viewing card carrying envelopes wherein slotted card carrying envelopes are pivotally mounted in the device so that they are movable from a horizontal storage position to a vertical viewing position and only removable from said container by pivoting the same to a position approximately midway between said storage and viewing positions.

3 Claims, 4 Drawing Figures

MAG CARD STORAGE DEVICE

BACKGROUND

The present invention generally relates to an information and retrieval system. In particular, it relates to a storage and viewing device for cards or the like.

In today's business world data processing and record keeping has become a very significant problem, due to the large volume of information that must be maintained. A partial answer to this problem has been the introduction of the technology of magnetically recording data.

A specific adaptation of this technology is the use of magnetic cards or "Mag Cards" in connection with a typewriter.

"Mag Cards" are thin, small flexible plastic cards which are easy to handle and file. As a typed card has approximately 50 recording tracks capable of storing about 5000 characters, it is far less space comsuming to store and less time consuming to use. However, like all data, it too must be stored yet be made readily available for use.

SUMMARY OF THE INVENTION

Accordingly, it is an object of the present invention to provide a storage and retrieval system for "Mag Cards" and the like.

It is another object of the present invention to provide a compact storage and viewing unit for "Mag Cards" and the like.

It is a further object of the present invention to provide a storage and viewing device for "Mag Cards" and the like wherein said cards are contained in protective envelopes.

It is a still further object of the present invention to provide a storage and viewing unit for "Mag Cards" and the like wherein said cards are contained in identifying envelopes and said envelopes are releasably held in said unit.

The above and other objects and advantages of the present invention will be apparent from the following description, the accompanying drawings and the appended claims.

DESCRIPTION OF PREFERRED EMBODIMENT

Figure 1:
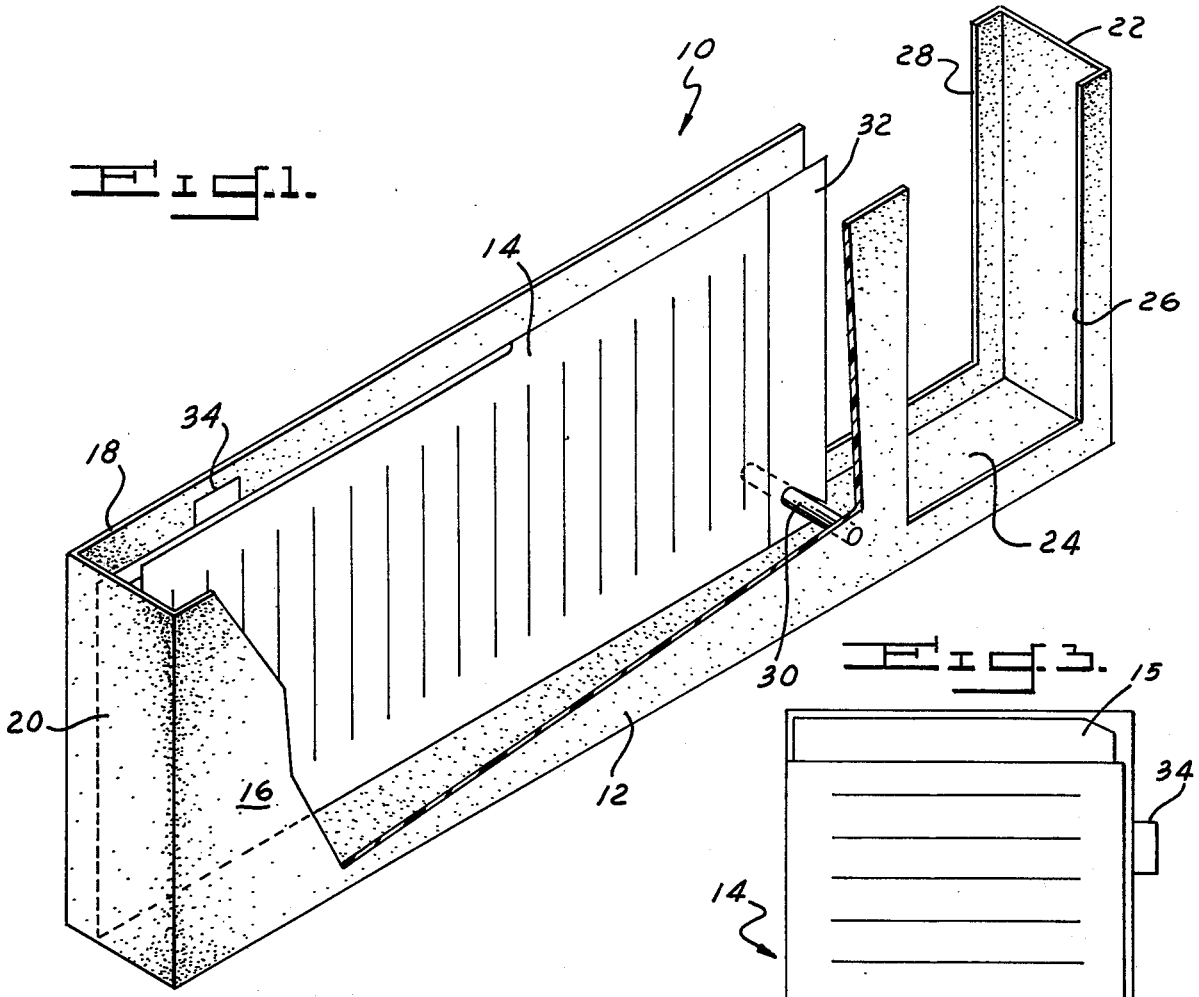
FIG. 1 is a front perspective view of the card filing device of the present invention having sections broken away.
Figure 2:
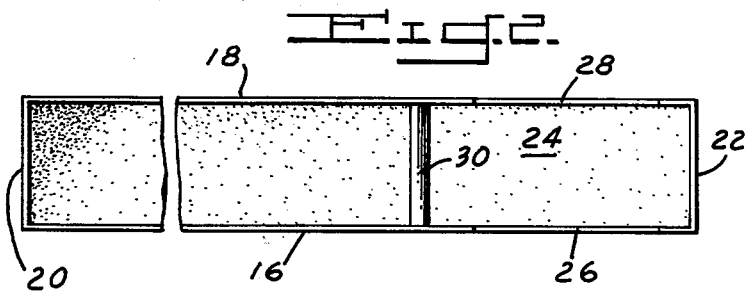
FIG. 2 is a top plan view of the device of FIG. 1.
Figure 4:
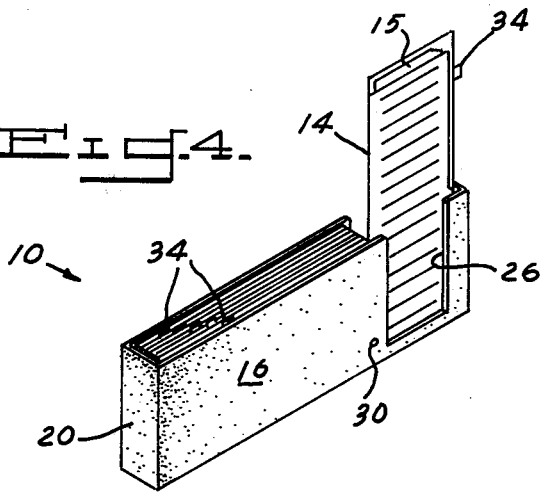
FIG. 4 is a perspective view of the card filing device of the present invention showing card envelopes in storage position and in various positions.

With reference to FIGS. 1, 2 and 4, it will be seen that the card filing device is designated as 10 and that it comprises two main parts, a container 12 and a plurality of card filing envelopes 14.

The container 12 is basically an open top, rectangular shaped box having front and rear walls 16 and 18, end walls 20 and 22 and a bottom 24. As shown, the front wall 16 is provided with a rectangular shaped opening or cut-out 26 disposed slightly inward of end wall 22. The opening 26 is open at the top and extends downwardly into said wall 16 to the bottom 24 or to a point slightly above the bottom 24, as depicted. Optionally, the back wall 18 is provided with a corresponding opening 28 located opposite said opening 26.

A pin or rod 30 is disposed between walls 16 and 18 so that its longitudinal axis is located above and approximately parallel to the bottom 24. As shown, the pin 30 acts as a pivot means for envelopes 14 and also retaining means for said envelopes as will be described further below.

Figure 3:
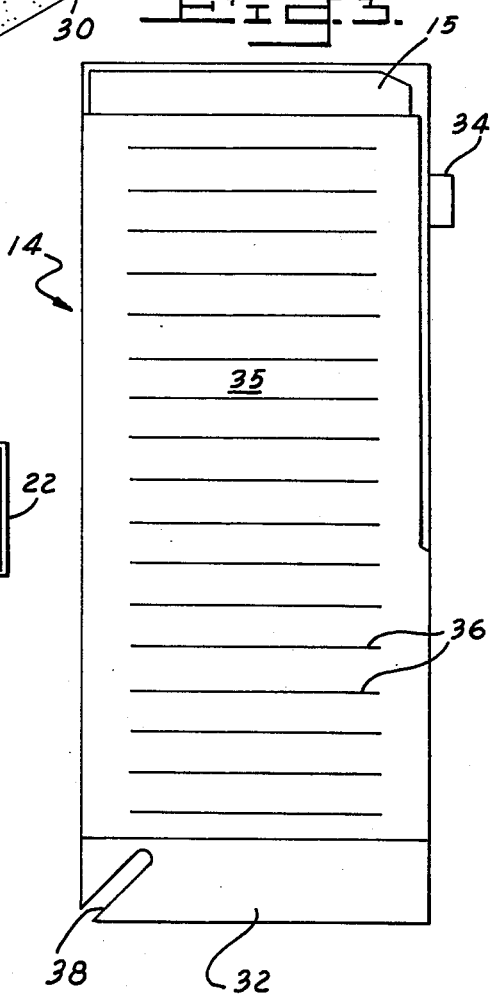
FIG. 3 is a front elevational view of a card filing envelope employed in the present invention.

As stated above, a plurality of card envelopes 14 are employed with the device for holding cards 15. Referring to FIG. 3, it will be noted that each envelope 14 is basically rectangular in shape with its long dimension along the sides thereof. As shown, the envelope 14 is of the sleeve type and is open at its top and at least partially along the right side thereof. Said envelope is provided with a false bottom or extension 32 and an index tab 34 adjacent the open side. Additionally, the front surface 35, and optionally the rear, of said envelope is provided with record identifying indicia 36 relating to the cards 15 carried by said envelopes.

A slot or notch 38, adapted to receive pin 30 of said container 12 is disposed approximately at a 45° to the horizontal in the corner of said false bottom 32 diagonally opposite said open side of said envelope 14.

With reference primarily to FIGS. 1 and 4, it will be noted that the card carrying envelopes 14 may assume two basic positions when used with the container 12. In the first or storage position, said envelopes are positioned on its closed side in said container so that the slot 38 is engaged with pin 30. In this position, the index tab 34 extends upwardly through the open top of said container, and the end of false bottom 32 extends to a point just short of said cut-out sections 26 and 28. The second or viewing position of said envelope is attained by rotating or pivoting said envelopes 14 clockwise about pin 30 from said storage position to an upright position, as depicted in FIGS. 1 and 4. In this viewing position, the identifying indicia 36 on the front 35 of said envelope 14 may be viewed through the opening 26, and the card 15 by said envelope easily removed therefrom for any desired purpose.

A unique feature provided by the device of the present invention is the manner in which envelopes 14 are removed or added to the container 12. As seen in the drawings, the envelopes are not removable from the container 12 while they are either in the storage or viewing position. This is due to the position of the slot 38 when engaged with pin 30 relative to the amount of clearance between the top of the envelope 14 and wall 20 when in the storage position or the right side of envelope 14 and wall 22 when in the viewing position. In order to remove or add envelopes 14, it is necessary to position the envelope approximately midway between the storage and viewing positions so that the slot 38 is disposed in an approximately vertical position.

That which is claimed is:

1. Filing device for storing and viewing card holding envelopes comprising an upwardly opening tray having a bottom and fixed upright side and ends walls and defining a continuous compartment from end to end thereof; said envelopes having a width dimension generally on the order of the height of said walls; each envelope including an extension at the lower end thereof which is provided with an oblique slot opening toward a lower corner thereof said envelopes being adapted for opening to provide access for insertion and removal of material from each envelope when in its upright position; a fixed pivot pin disposed transversely of the tray at a distance from one end wall less than the width of said envelopes and defining with that end wall a viewing section and at a distance from the opposite end wall less than the overall length of said envelopes and defining with said opposite end wall a storage section, said pin also being spaced above said bottom sufficient to support the slotted lower corner portions of the envelopes above said bottom wall whereby with said slot fitted onto said pin, the envelopes are freely pivotable between horizontal and vertical positions from the storage to the viewing section with a side resting on the bottom of said tray in the horizontal position, and the lower edge thereof disposed on the bottom of said tray in said vertical position, the slot of each envelope being adapted to fit onto and be removed from said pin only at an oblique angular orientation intermediate said horizontal and vertical positions, said pin and said end walls serving to retain said envelopes within said tray at other than said oblique angular orientation.

2. Filing device as set forth in claim 1 wherein said tray includes an opening through at least one of the upright side walls of the viewing section thereof for visual inspection of at least one side of an envelope disposed vertically in said viewing section.

3. Filing device as set forth in claim 1 wherein each envelope includes an index tab disposed on an edge portion thereof generally diagonally from said slot.

* * * * *